US008256033B2

(12) United States Patent
Arai

(10) Patent No.: US 8,256,033 B2
(45) Date of Patent: Sep. 4, 2012

(54) OPEN FACE HELMET

(76) Inventor: Michio Arai, Saitama (JP)

( * ) Notice: Subject to any disclaimer, the term of this patent is extended or adjusted under 35 U.S.C. 154(b) by 65 days.

(21) Appl. No.: 12/805,136

(22) Filed: Jul. 14, 2010

(65) Prior Publication Data

US 2011/0088147 A1 Apr. 21, 2011

(30) Foreign Application Priority Data

Oct. 19, 2009 (JP) ..... 2009-240357

(51) Int. Cl.
*A42B 3/10* (2006.01)

(52) U.S. Cl. ..... 2/414

(58) Field of Classification Search ..... 2/414, 267, 2/411, 412, 467, 425
See application file for complete search history.

(56) References Cited

U.S. PATENT DOCUMENTS

| | | | | |
|---|---|---|---|---|
| 2,863,151 | A * | 12/1958 | Morgan, Jr. | 2/414 |
| 4,282,610 | A * | 8/1981 | Steigerwald et al. | 2/414 |
| 4,831,668 | A * | 5/1989 | Schulz | 2/414 |
| 4,916,759 | A | 4/1990 | Arai | |
| 6,138,284 | A * | 10/2000 | Arai | 2/414 |
| 6,185,753 | B1 * | 2/2001 | Arai | 2/414 |
| 6,370,699 | B1 * | 4/2002 | Halstead et al. | 2/414 |
| 6,421,841 | B2 * | 7/2002 | Ikeda | 2/414 |
| 7,841,025 | B1 * | 11/2010 | Fink et al. | 2/414 |

FOREIGN PATENT DOCUMENTS

| | | |
|---|---|---|
| JP | 58045325 | 3/1983 |
| JP | 09170109 | 6/1997 |
| JP | 10204717 | 8/1998 |

OTHER PUBLICATIONS

English Abstract of JP09170109.
English Abstract of JP 10204717.

* cited by examiner

*Primary Examiner* — Danny Worrell
(74) *Attorney, Agent, or Firm* — Dykema Gossett PLLC

(57) ABSTRACT

An open face helmet includes an outer shell and a shock-absorbing liner, as well as a fixing member on the front side of the inner surface of the right side of the outer shell for the attachment of a removable cheek pad. The cheek pad includes a shock-absorbing member and a cushioning member stacked thereon, as well as an engaging body to be removably engaged with the fixing member. The fixing member is opposed to the front edge of the shock-absorbing liner, having a slit to be engaged with or disengaged from the engaging body in a front-back direction. The cheek pad is supported on the inner surface of the right side of the helmet shell by an engagement of the engaging body with the slit and a face-to-face contact of the back edge of the cheek pad with the front edge of the shock-absorbing liner.

7 Claims, 4 Drawing Sheets

OPEN FACE HELMET

FIELD OF THE INVENTION

The present invention relates to an open face helmet intended to use with various types of vehicles such as automobiles, motorcycles and bicycles, vessels such as motor boats, and other types of moving apparatus. More, specifically, it relates to an open face helmet provided with a removable cheek pad for replacing and/or adjusting a cheek part to the face of a wearer.

BACKGROUND TECHNOLOGY

An open face helmet which provides a removable cheek pad configured to contact a wearer's face and provide a comfortable feeling is known.

The open face helmet described below in patent document 1 is provided with a cheek pad including a pad body which is multilayered with a shock-absorbing member and a cushioning member having shape-retaining and shock-absorbing properties, covered with an exterior member and a thin attaching plate. The cheek pad shown in the patent document 1 is removably attached to the helmet by engaging or disengaging a plurality of projections provided on the attaching plate with a number of engaging holes provided on a base plate attached on the inner sides of a helmet shell from a right-and-left direction.

RELEVANT ART DOCUMENTS

[Patent Documents]

[PATENT DOCUMENT 1] Publication of Unexamined Patent Application H09-170109

SUMMARY OF THE INVENTION

Problems to be Solved by the Invention

According to the relevant art shown in patent document 1, an open face helmet may provide a removable cheek pad which covers a wearer's cheek.

According to an attaching configuration of the cheek pad as shown in the patent document 1, a space is provided between a base member on which the cheek pad is attached and the inner surface of both sides of the helmet shell to accept the projections provided on the cheek pad, engaged with the engaging holes provided on the base member by passing therethrough. Since the base member has the same surface contour as the cheek pad, the space is provided substantially over the whole base member.

However, the check pad shown in patent document 1 may sacrifice some thickness of the cushion member due to the provided space described above. Further, according to the attaching configuration shown in the patent document 1, since a number of the projections are required to be engaged or disengaged with the respective counterpart engaging holes, attaching or removing the cheek pad will take time.

The present invention is intended to address such a problem. In other words, the objects of the present invention are to form a cheek pad with cushioning and shape-retaining properties, which is easily attached and removed without a base member, and which provides a light weight open face helmet.

Means for Solving the Problems

To achieve the above-mentioned objects, the open face helmet according to the present invention is provided with at least the following configuration.

According to one aspect, an open face helmet which includes a helmet shell as a shell having a shock-absorbing liner and a removable cheek pad configured to support a helmet wearer's cheek on the inner surface of the right-and-left sides of the helmet shell, includes a shock-absorbing member having shape-retaining properties and shock-absorbing properties and a cushioning member stacked on the shock-absorbing member in a thickness direction, and a fixing member on a front side of the inner surface of the right-and-left sides of the helmet shell facing the cheek pad to removably fix the cheek pad, and an engaging body to be removably engaged with the fixing member on the shock-absorbing member, and the fixing member beinq opposed to the front edge of a shock-absorbing liner, having a slit to be engaged with or disengaged from the engaging body in a front-back direction, wherein the cheek pad is supported on the inner surface of the right-and-left sides of the helmet shell by an engagement of the engaging body with the slit and a face-to-face contact of the back edge of the cheek pad with the front edge of the shock-absorbing liner.

Effect of the Invention

According to the aspect as described above, the present invention yields the following effects. Since the cheek pad is configured to be supported by an engagement of the engaging body with the slit of the fixing member and a face-to-face contact of the back edge of the cheek pad with the front edge of the shock-absorbing liner, the cheek pad having a cushioning properties and a shape-retaining properties can be easily attached or removed without the base member. With no longer the base member, the opening face helmet becomes lighter weight than before.

BRIEF DESCRIPTION OF THE DRAWINGS

FIGS. 2A and 2B show configurations of a cheek pad, wherein FIG. 2A is a perspective view from a cushioning member side and FIG. 2B is a perspective view from a shock-absorbing member side.

FIGS. 3A and 3B are cross-sectional views taken along the line (III) - (III) of FIG. 1, wherein FIG. 3A shows an attached state of the cheek pad and FIG. 3B shows a attaching or removing state of the cheek pad.

EMBODIMENTS FOR PRACTICING THE PRESENT INVENTION

The open face helmet according to the present invention is a type of helmet that exposes a whole face of the wearer. The open face helmet according to the present invention includes an open face plus full face type of helmet as disclosed, for example, in the Publication of Unexamined Patent Application H 07-126908, in which a front open part of a helmet shell of an open face type is covered with a shield rotatable around a supporting point on right-and-left sides of the helmet shell, and a chin guard is rotatably and fixably attached on a supporting axis of the shield, crossing over the front open part between both the sides of the helmet shell.

The helmet shell according to the present invention constitutes the most outer layer of the open face helmet, molded in the shape of the open face helmet by using a fiber-reinforced resin material (GFRP, CFRA, etc.) made by impregnating, for example, a reinforcing fiber material (glass fiber, carbon fiber, etc.) with a thermoset resin material (epoxy resin material, phenol resin material, etc.), or a thermoplastic resin (polycarbonate, etc.).

The shock-absorbing liner according to the present invention is shaped in accordance with the inner surface of the helmet shell by using a material with shock-absorbing performance (for example, styrofoam) or an alternative material with the same shock-absorbing performance as this material.

The shock-absorbing member according to the present invention is shaped in accordance with cheek region on the inner surface of the helmet shell in a general open face helmet by using the same material (for example, styrofoam) as the shock-absorbing liner attached to the inner surface of the helmet shell, or a material with the same shock-absorbing performance as this material.

The cushioning member according to the present invention is shaped so as to contact a part of the wearer's cheek by using, for example, a urethane foamed material or a material with the same flexibility as this material.

In one embodiment of attaching the fixing member according to the present invention, for example, the end of the fixing member, may be held by an edge member fixed to an edge part of the helmet shell.

In one embodiment of the engaging body according to the present invention, for example, the engaging body may be connected to one end of a connecting part passing through the shock-absorbing member in the thickness direction, and the shock-absorbing member is fixed between the engaging body and a holding body connected to the other end of the connecting part.

In one embodiment of the cheek pad according to the present invention, the cheek pad is formed facing the whole inner surface of the right-and-left sides, provided with a chin-strap passing through-hole passing through the shock-absorbing member and said cushioning member.

Hereinafter, one embodiment of an open face helmet (hereinafter referred to as a helmet) is described with reference to the drawings.

Figure 1:
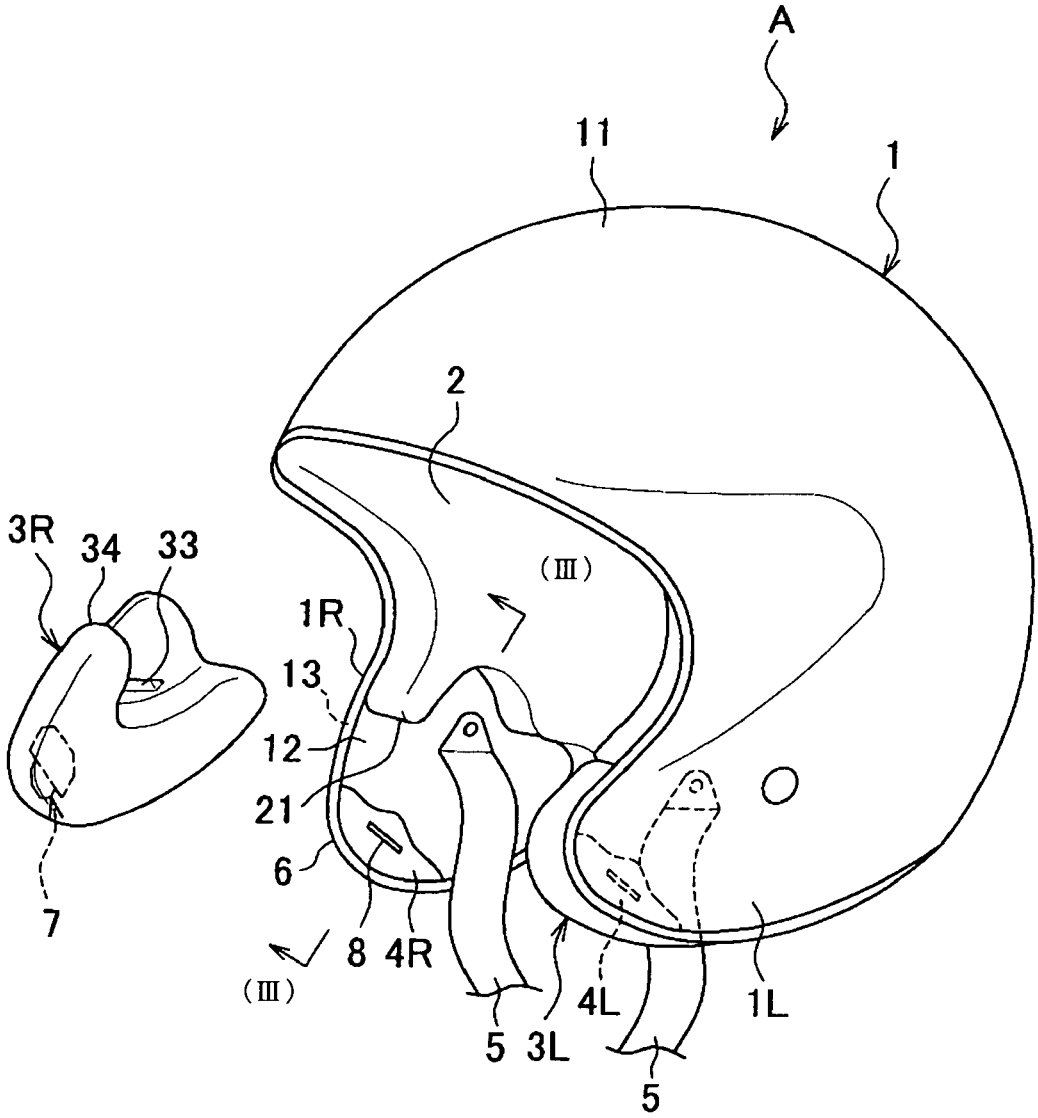
FIG. 1 shows a whole configuration of an open face helmet according to the present invention.

FIG. 1 shows a whole configuration of a helmet A. The helmet A includes a shock-absorbing liner 2 shaped by using Styrofoam® or a material with the same shock-absorbing performance as Styrofoam® on an inner surface of a head part 11 of a helmet shell 1, which is molded in the open face shape with a fiber-reinforced resin material (GFRP, CFRP, etc.), a head pad 20 (see FIGS. 3A and 3B) made of urethane material, etc., and provided on an inner side of the shock-absorbing liner 2, cheek pads 3L and 3R removably attached to an inner surface 12 of right-and left sides 1R, 1L corresponding to a cheek part of the helmet shell 1, fixing members 4L, 4R configured to attach the cheek pads 3L and 3R to the right-and-left sides 1L, 1R, and a pair of chin-straps 5 supported on axes of the right-and left sides 1R, 1L.

Since right side 1R_and left side 1L, cheek pad 3R and cheek pad 3L, and fixing member 4R and fixing member 4L are respectively bilaterally symmetrical as well as identically configured, description will be made hereinafter only by reference to the right side 1R, cheek pad 3R and fixing member 4R.

On the whole edge part 13 of the helmet shell 1, an edge member 6 is fixed to cover the edge part 13. The edge member 6 is formed in a U cross-sectional shape (see FIGS. 3A and 3B), engageable with and fixable to the edge part 13 so as to cover the inner and outer sides of the helmet shell 1 by using a rubber material or a flexible synthetic resin material, etc., in a length to allow it to be fixed to the whole edge part 13.

Figure 2B:
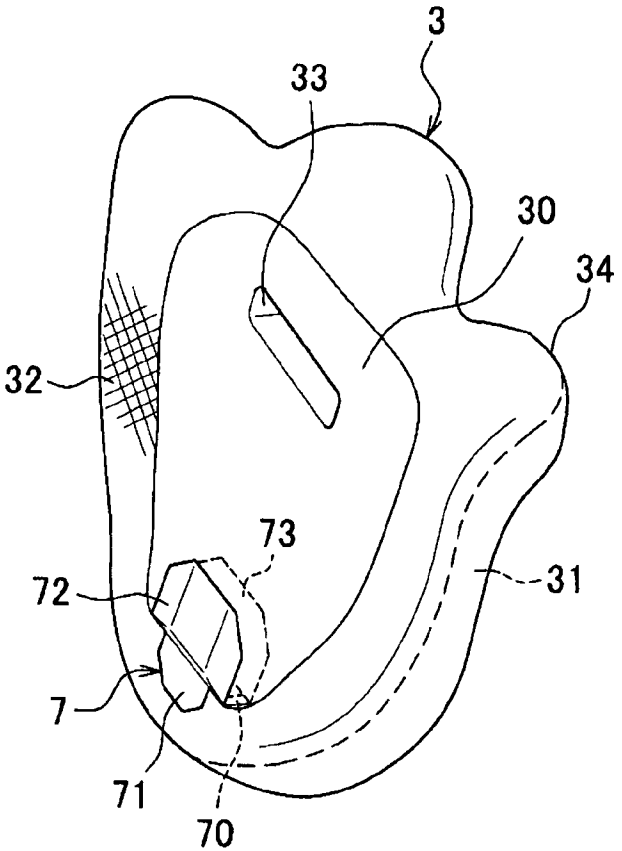
Figure 2A:
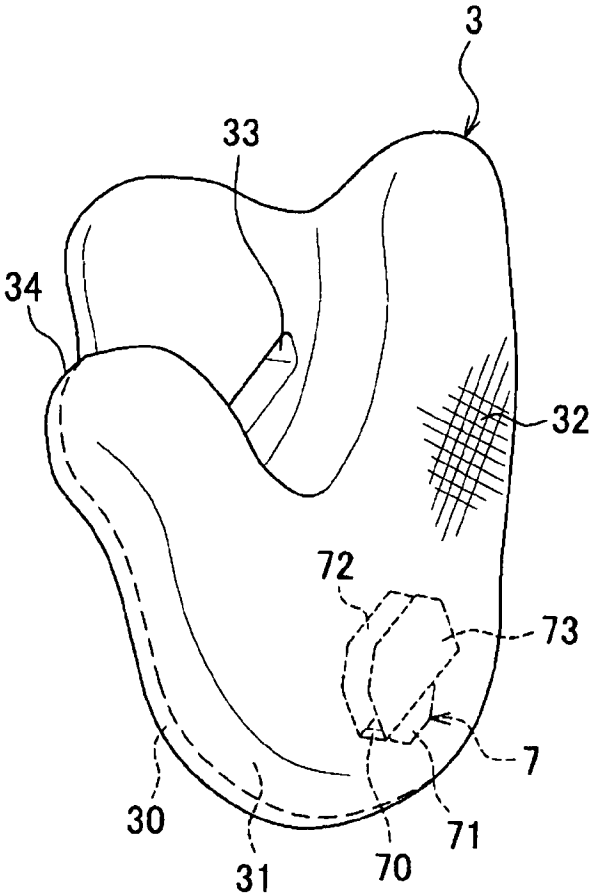

FIGS. 2A and 2B are perspective views of the cheek pad 3R. The cheek pad 3R includes a shock-absorbing member 30 formed of the same material as the shock-absorbing liner 2 and a cushioning member 31 formed of the same material as a head cheek pad 20. The shock-absorbing member 30 and cushioning member 31 are covered with an exterior member 32.

The shock-absorbing member 30 is formed with its surface contour corresponding to the inner surface 12 of the right side 1R of the helmet shell 1. An engaging body 7 removably engaged with the fixing member 4R is buried and fixed in the surface of the shock-absorbing member 30 facing to the right side 1R. The shock-absorbing member 30 is provided with a hole 33 through which a chin-strap 5 passes.

The cushioning member 31 has its planar shape formed in a horseshoe shape and is bonded over the surface of shock-absorbing member 30 facing the wearer with the hole 33 to which the chin-strap is exposed.

Figure 3B:
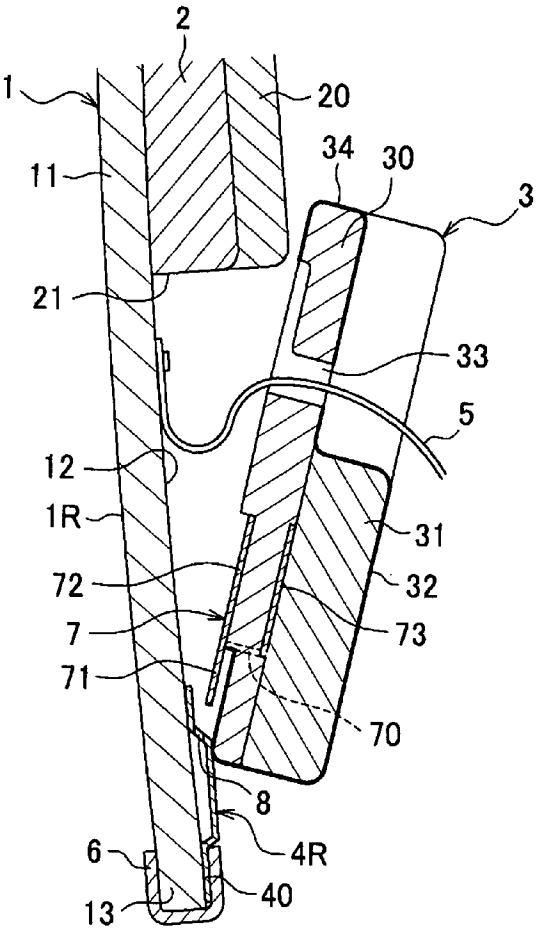
Figure 3A:
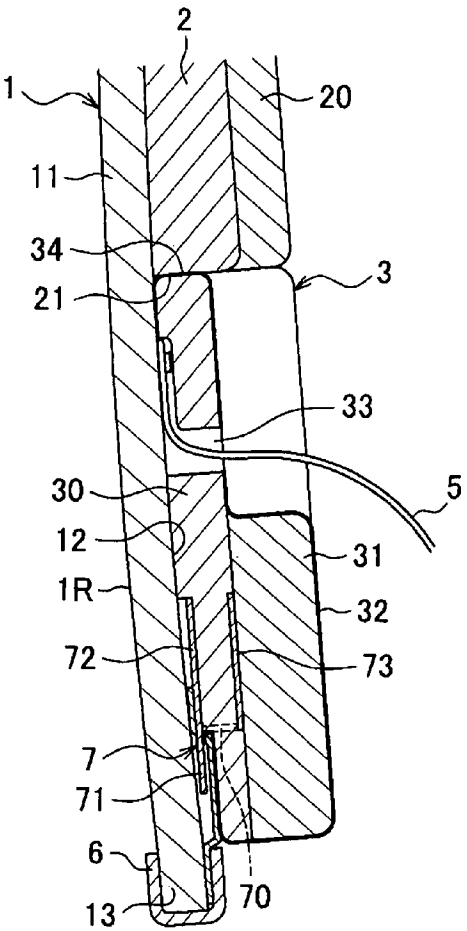
Figure 4:
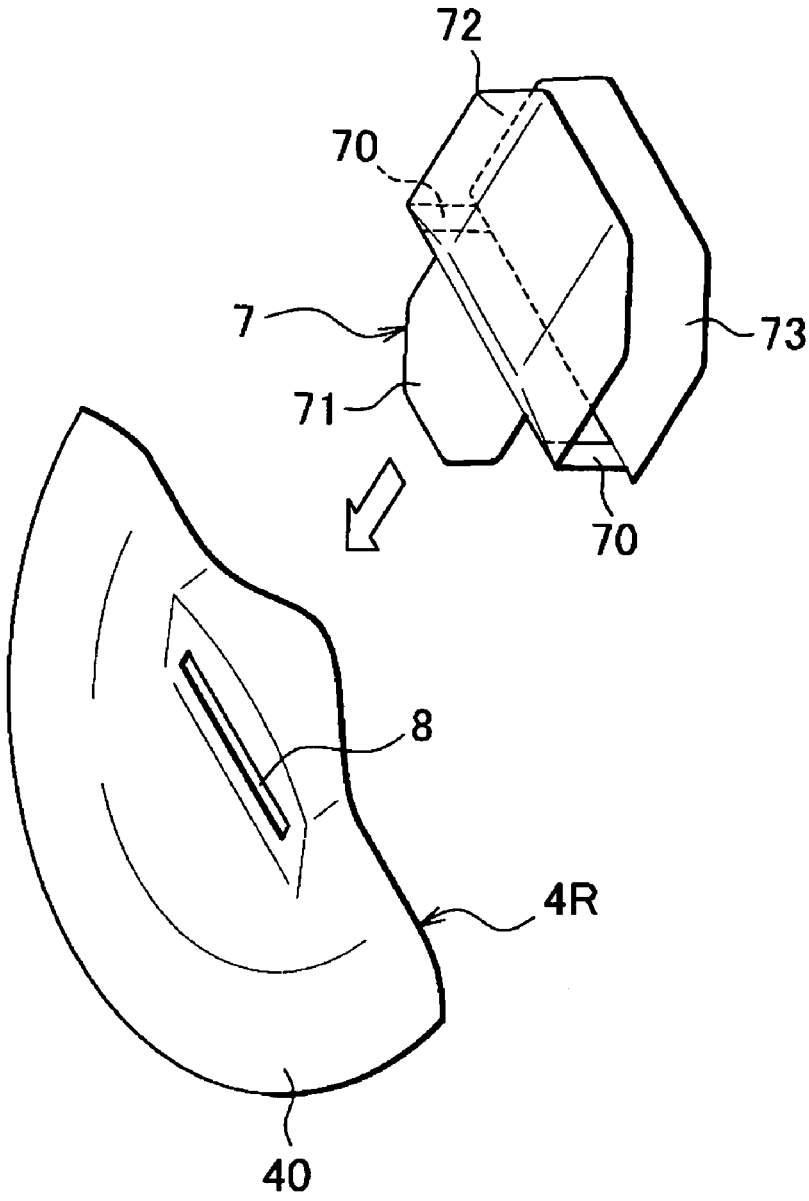
FIG. 4 is a perspective view of an engaging body and a fixing member.

FIGS. 3A and 3B are views showing an attaching or removing state of the cheek pad 3R with respect to the inner surface 12 of the right side 1R, and FIG. 4 is a view showing a configuration of engaging body 7 and a fixing member 4R.

On the side of helmet shell 1, the engaging body 7 is connected to the end of a connecting part 70 passing through the shock-absorbing member 30 in the thickness direction, and includes an engaging piece 71 to be engaged with the fixing member 4R and a fixed piece 72 extending from the engaging piece 71 and connected to the connecting part 70. The fixed piece 72 is bonded to the shock-absorbing member 30 on the surface facing the helmet shell 1. A holding body 73 is connected to the end of the connecting part 70 on the side of the cushioning member 31. The holding body 73 is bonded to the surface of the shock-absorbing member 30 facing to-the cushioning member 31. In other words, the engaging body 7 is fixed to the shock-absorbing member 30 with the connecting part 70 passing through the shock-absorbing member 30 while the shock-absorbing member 30 is held between the holding body 73 and the fixed piece 72.

The engaging body 7, connecting part 70 and holding body 73 are integrally formed with a flexible synthetic resin material, which is easily deformed when the shock-absorbing member 30 absorbs a shock. The engaging body 7, connecting part 70 and holding body 73 are deformed when absorbing a shock, and thus not affecting the wearer.

The engaging body 7, connecting part 70 and holding body 73 may be thinly and integrally formed such that they can be easily deformed when the shock-absorbing member 30 absorbs a shock (not shown). Further, when the engaging body 7, connecting part 70 and holding body 73 are formed with a material comparatively hard to deform, the connecting part 70 may be slanted by an angle of 20° to 60° with respect to the thickness direction of the shock-absorbing member 30 toward the front or back side of the helmet shell 1, and thus the connecting part 70 may be easily deformed when absorbing a shock (not shown). Further, the connecting part 70 made of a synthetic resin material flexible enough to be easily deformed or a synthetic resin material thin enough to be easily deformed, may be slanted by the above-mentioned angle, and thus a deformability resulting from nature of the material as well as a deformability resulting from the angle of the connecting part may be applied (not shown).

The fixing member 4R is formed in a shape fitting the side surface along the inner surface 12 of the right side 1R from the front end to backward halfway portion by using comparatively hard synthetic resin. An inserted edge 40 is formed on the edge part except for the back side part of the fixing member 4R so as to be inserted between an edge member 6 and the inner surface 12 of the right side 1R. The inserted edge 40 is bonded to the edge member 6, and thus the fixing member 4R is held by the inner surface 12 of the right side 1R. The fixing member 4R has a slit 8 in which the engaging body 7 is removably engaged.

The slit 8 is formed in a backward direction of the helmet shell 1 as it faces the front edge 21 of the shock-absorbing liner 2. The slit 8 has a shape substantially fitted to the cross-sectional shape of the engaging body 7. The substantially fitting shape is such a shape that the periphery of the engaging body 7 is slightly contacted with the fringe of the slit 8 in which the engaging body 7 is engaged, and thus the engaging body 7 has little allowance in the slit 8, while the engaging body 7 can be substantially smoothly engaged or disengaged with the slit 8. The shape of the slit 8 according to the present invention is not limited to the shape substantially fitted with the above-mentioned cross-sectional shape of the engaging body 7, but includes such a shape that gives some resistance in the engagement or disengagement of the engaging body 7.

Since the fixing member 4R in this embodiment is formed fitted with a part of the front side including the front end of the inner surface of 12 of the right side 1R by using a synthetic resin material, the weight of a helmet A can be effectively reduced compared to those including the above-mentioned conventional base member covering the whole right side. In addition, since the cheek pad 3R can be in contact with and attached to the inner surface 12 of the right side 1R except for the fixing member 4R, the region of the cheek pad 3R facing the portion of the inner surface 12 of the right side 1R except for the fixing member 4R can be thickened at least by the thickness of the above-mentioned conventional base member, which covers the right side, and thus the shock-absorbing member 30 can be thickened to the extent that the cheek pad 3R can be thickened for shock-absorbing performance of the helmet A.

Although the area of the fixing member 4R is required only to the extent that it can accommodate at least the slit 8 as well as the space into which the engaging body 7 engaged with the slit 8 is inserted, it should preferably be made as small as possible in order to enlarge the area of the shock-absorbing member 30 of the cheek pad 3R to be thickened or reduce the weight of the helmet A. The shape of the fixing member 4R is not limited to the shape exemplified in this embodiment, but includes the shape having no part facing the front end side of the inner surface 12 of the right side 1R with the inserted edge 40 including upper and lower edges (not shown).

The cheek pad 3R is fitted into the fixing member 4R such that the whole engaging piece 71 of the engaging body 7 is inserted through the slit 8 from back to front side and is engaged with the fixing member 4R, wherein the root of the engaging piece 71 comes in contact with the peripheral edge of the slit 8 from behind while the front edge 21 of the shock-absorbing liner 2 and the back edge 34 of the cheek pad 3R are in contact with one another, as shown in FIGS. 3A and 3B. Further, in this fitting embodiment, the cheek-strap 5 is inserted through a chin-strap inserting hole 33 of the cheek pad 3R from the opposite side to the right side 1R to the inside of the helmet shell 1.

According to this embodiment of fitting the cheek pad 3R, the engaging body 7 is inserted into the slit 8 from behind and fitted in the fixing member 4R while the front edge 21 of the shock-absorbing liner 2 and the back edge 34 of the cheek pad 3R are in face-to-face contact with one another, and thus the cheek pad 3R is prevented from moving horizontally as well as vertically. Therefore, since the cheek pad 3R can be prevented from moving horizontally as well as vertically, the cheek pad 3R can be fitted into the fixing member 4R without allowance while the cheek pad 3R can be prevented from dropping off the fixing member 4R when wearing or removing the helmet A. Further, the contact pressure of the back edge 34 to the front edge 21 is applied such that no horizontal displacement occurs horizontally when carrying the helmet A under normal conditions and the cheek pad 3R can be horizontally displaced by applying man-made force, and thus the cheek pad 3R does not drop off the fixing member 4R.

The cheek pad 3R is removed such that the back edge 34 of the cheek pad 3R is displaced in the inward direction of the helmet shell 1, then the face-to-face contact of the back edge 34 to the front edge 21 of the shock-absorbing liner 2 is released (see FIG. 3B). Specifically, the slit 8 is forced to open using a leverage in which the tip of the engaging body 7 is in contact with the inner surface 12 of the right side 1R as a supporting point and a contact part of the engaging body 7 with respect to the edge of the slit 8 on the side of cheek pad 3R functions as a working point. In other words, a clearance made by forcing open the slit 8 allows the back edge 34 of the cheek pad 3R to move in the inward direction of the helmet shell 1. Then, the engaging body 7 is pulled out of the slit 8 by displacing the cheek pad 3R obliquely backward, thereby the cheek pad 3R can be disengaged.

The cheek pad 3R can be attached in accordance with a reversed operation with respect to the removing process as mentioned above. Specifically, keeping the cheek pad 3R as oblique as when it is removed, the engaging body 7 is advanced toward the slit 8 obliquely forward (see FIG. 3B). Then, engaging body 7 is inserted into and engaged with the slit 8, and the back edge 34 of the cheek pad 3R is pushed down in a direction of the right side 1R to come into contact with the front edge 21 of the shock-absorbing liner 2, thereby the cheek pad 3R can be attached on the helmet A.

According to this embodiment, the cheek pad 3R can be easily and quickly attached on or removed from the helmet A, since the cheek pad 3R can be removed from the helmet A through two processes of displacing the back edge 34 of the cheek pad 3R inward and pulling the engaging body 7 out of the slit 8 by moving the cheek pad 3R backward, while the cheek pad 3R can be attached on the helmet A through two processes of pushing the engaging body 7 into the slit 8 and pushing down the back edge 34 of the cheek pad 3R in a direction of the inner surface 12 of the right side 1R.

According to this embodiment of attaching the cheek pad 3R, as a posture of the cheek pad 3R in which the back edge 34 is displaced obliquely upward on the helmet shell 1 when attaching or removing the cheek pad 3R, the smaller the angle of the cheek pad 3R is, the more easily the engaging body 7 can be engaged or disengaged with the slit 8. Thus, the angle of the cheek pad 3R to the inner surface 12 of the right side 1R when attaching or removing the cheek pad 3R is preferably adjusted to be small by placing the opening position of the slit 8 as forward as possible.

In addition, the area of the fixing member 4R can be reduced by placing forward the opening position of the slit 8.

As such, it is possible to provide a helmet A with shape-retaining properties, which makes it easy to wear or remove a cheek pad, and light weight according to this embodiment.

Note that the present invention is not limited to the embodiments as exemplified above and can be practiced by a configuration not departing from what is disclosed in each of the following claims.

What is claimed is:

1. An open face helmet which comprises:

an outer shell which defines a head part, right and left sides, and a completely open front, a shock-absorbing liner in said head part on an inner surface thereof, respective fixing members on inner surfaces of said right and left sides near said open front for the mounting of respective right and left cheek pads, each of said fixing members defining a slit which extends in a front-to-back direction relative to said outer shell, and respective right and left cheek pads which are attachable to the inner surfaces of the right and left sides of said outer shell, each of said right and left cheek pads including a shock-absorbing member having shock-absorbing and shape-retaining properties and a cushioning member stacked on the shock-absorbing member in a thickness direction, and an engaging body which can engage with a slit of a respective fixing member, each of said right and left cheek pads defining a back edge which abuts a respective front edge of said shock-absorbing liner.

2. The open face helmet according to claim 1, wherein each said fixing member has an end part held in an edge member fixed to an edge part of said outer shell.

3. The open face helmet according to claim 1, wherein each said engaging body is connected to one end of a connecting part passing through a respective said shock-absorbing member in the thickness direction, and each said shock-absorbing member is fixed between said engaging body and a holding body connected to a second end of the connecting part.

4. The open face helmet according to claim 2, wherein each said engaging body is connected to one end of a connecting part passing through said shock-absorbing member in the thickness direction, and each said shock-absorbing member is fixed between said engaging body and a holding body connected to second end of the connecting part.

5. The open face helmet according to claim 1, wherein each said cheek pad has a form of facing the inner surface of said respective right-and-left sides, and includes a chin-strap through-hole passing through said shock-absorbing member and said cushioning member thereof.

6. The open face helmet according to claim 2, wherein said cheek pad has a form of facing the inner surface of said respective right-and-left sides, and includes a chin-strap through-hole passing through said shock-absorbing member and said cushioning member thereof.

7. The open face helmet according to claim 3, wherein said cheek pad has a form facing the inner surface of said respective right-and-left sides, and includes a chin-strap through-hole passing through said shock-absorbing member and said cushioning member thereof.

* * * * *